US005924476A

United States Patent [19]

Spink

[11] Patent Number: 5,924,476

[45] Date of Patent: Jul. 20, 1999

[54] CASTING STEEL STRIP

[75] Inventor: John Anthony Spink, Shellharbour, Australia

[73] Assignees: Ishikawajima-Harima Heavey Industries Co. Ltd., Tokyo, Japan; BHP Steel (JLA) Pty. Ltd, Melbourne, Australia

[21] Appl. No.: 08/958,908

[22] Filed: Oct. 28, 1997

[30] Foreign Application Priority Data

Sep. 17, 1997 [AU] Australia ..... P09261

[51] Int. Cl.[6] ..... B22D 11/10

[52] U.S. Cl. ..... 164/480; 164/428; 164/437; 164/488; 222/606

[58] Field of Search ..... 164/437, 488, 164/428, 480; 222/606, 607

[56] References Cited

FOREIGN PATENT DOCUMENTS 58-32554 2/1983 Japan ..... 164/437

59-162174 9/1994 Japan ..... 164/437

*Primary Examiner*—Kuang Y. Lin

*Attorney, Agent, or Firm*—Kerkam, Stowell, Kondracki & Clarke, P.C.; John C. Kerins

[57] ABSTRACT

Continuous casting of steel strip in twin-roll caster comprising casting rolls (16). Molten steel is delivered by a delivery system comprising a distributor (18) and delivery nozzle (19) to casting pool (68) supported above the nip (69) between the casting rolls (16) which are rotated to deliver a solidified steel strip (20) downwardly from the nip. Delivery nozzle (19) dips into casting pool (68). To minimise reactions between carbon in the delivery nozzle with oxygen containing compounds in the casting pool the delivery nozzle is made of refractory material containing a major proportion of a refractory aggregate and a minor proportion of graphite of at least 96% purity in the range of 15% to 25% by weight and an anti-oxidant additive being aluminium or an alloy thereof. The refractory aggregate may be comprised mainly of alumina.

26 Claims, 10 Drawing Sheets

CASTING STEEL STRIP

TECHNICAL FIELD

This invention relates to the casting of steel strip.

It is known to cast metal strip by continuous casting in a twin roll caster. In this technique molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

Although twin roll casting has been applied with some success to non-ferrous metals which solidify rapidly on cooling, there have been problems in applying the technique to the casting of ferrous metals. One particular problem encountered in the casting of aluminium killed steel in a twin roll strip caster is the propensity for molten steel to produce solid inclusions, in particular inclusions which contain aluminates. Such inclusions can affect the surface quality of the strip as well as having the tendency to block any small casting passages in the metal delivery system. This has led to the use of manganese/silicon killed steels as an alternative, such as described in our New Zealand Patent Application 270147. However, such silicon/manganese killed steels have inherently a significantly higher oxygen content than aluminium killed steels and this, along with the ability of oxides present in the molten steel to be reduced, gives rise to problems in casters in which the delivery nozzle formed of refractory material containing carbon dips into the casting pool, the pool being disturbed by carbon monoxide bubbles generated by reactions between carbon in the submerged delivery nozzle and oxygen containing compounds in the molten metal of the casting pool. More particularly, ferrous oxide or other oxides in the slag present in the casting pool react with carbon to be reduced to iron or other metals respectively. The pool disturbance caused by the carbon monoxide bubbles from such reduction leads to the formation of discrete waves in the casting pool which are reflected in the cast strip as depressions in the strip surface. These defects are commonly referred to as meniscus marks. Moreover, carbon leaching from the refractory material of the metal delivery nozzle is enhanced.

It should be noted that in casting aluminium killed steels the aluminates present in the molten metal are not readily reduced and in fact carbon cannot reduce same under such casting conditions.

Our International Patent Application PCT/AU96/00244 describes a proposal to address this problem by the controlled addition of sulphur to the silicon/manganese killed steel melt at least in the start-up phase of a casting operation. However, the controlled addition of sulphur to the steel adds complexity to the process and results in the production of steel with high sulphur content which may not generally be acceptable to all markets. By the present invention the problem is addressed by modifying the chemical composition of the refractory material of the delivery nozzle rather than that of the steel melt.

DISCLOSURE OF THE INVENTION

According to the invention there is provided method of continuously casting steel strip of the kind in which molten steel is introduced into the nip between a pair of parallel casting rolls via a submerged metal delivery nozzle to create a casting pool of molten steel supported on casting surfaces of the rolls immediately above the nip and the casting rolls are rotated to deliver a solidified steel strip downwardly from the nip, wherein the delivery nozzle is comprised of a refractory material comprising a major proportion of a refractory aggregate and a minor proportion of graphite in the range of 15 to 25% by weight and an anti-oxidant additive being aluminium or an alloy thereof, and wherein the graphite has a purity of at least 96%.

The invention also provides apparatus for casting steel strip, comprising a pair of parallel casting rolls forming a nip between them, an elongate delivery nozzle disposed above and extending along the nip between the casting rolls for delivery of molten steel into the nip to form a casting pool of molten steel supported on casting surfaces of the rolls above the nip, and means to rotate the rolls to produce a solidified steel strip passing downwardly from the nip, wherein the delivery nozzle is formed of a refractory material comprising a major proportion of a refractory aggregate and a minor proportion of graphite in the range of 15 to 25% by weight and an anti-oxidant additive being aluminium or an alloy thereof, and wherein the graphite has a purity of at least 96%.

The invention also extends to a refractory nozzle for delivery of molten steel to a twin roll strip caster, comprising a refractory body defining an upwardly opening inlet adapted to receive molten metal and bottom outlet means for outflow of the molten metal wherein the refractory body is made of a refractory material comprising a major proportion of a refractory aggregate and a minor proportion graphite in the range of 15 to 25% by weight and an anti-oxidant additive being aluminium or an alloy thereof and wherein the graphite has a purity of at least 96%.

Preferably the purity of the graphite is of the order of 98% or higher.

Preferably the anti-oxidant additive contains the metal aluminium.

Preferably further the amount of the anti-oxidant additive in the refractory material is around 2% by weight.

It is preferred that the proportion of graphite be of the order of 20 to 24%.

The refractory aggregate may comprise any one or more of the compounds alumina, magnesia, zirconia and spinel. However, it is preferable that the aggregate be comprised mainly of alumina.

Preferably, any additives are such that the refractory material is essentially free of sodium.

The refractory aggregate will generally be selected on the basis of thermal shock resistance, corrosion resistance and cost. Carbon components are generally added to refractory materials used in metal delivery nozzles to provide good thermal shock resistance, machining capability and corrosion resistance. If carbon is used in the refractory material for this purpose it then becomes desirable to provide additives to protect the carbon from oxidation and to increase the strength of the refractory material. Common additives include borax, boron carbide, silicon, aluminium and magnesium aluminium alloy.

As a result of experimental work to be described below we have determined that in order to avoid the carbon leaching and gas generation problem in metal delivery nozzles it is critically important that the carbon component be in the form of graphite of very high purity. The quantity of graphite is also important although not as critical as the purity of the graphite. However, an important factor influencing the quantity of graphite is the need to have a sufficient amount of graphite in the refractory nozzle to avoid the nozzle cracking from thermal shock upon contact with the molten metal.

The experimental work has shown that the presence of sodium in the refractory material will be detrimental and cause increase gas generation. Accordingly refractory material should preferably not contain soda additions and any anti-oxidant additions should preferably not contain sodium. It has been shown that the anti-oxidants containing aluminium cause the least generation of gas and such anti-oxidants are preferred.

BRIEF DESCRIPTION OF THE DRAWINGS

In order that the invention may be more fully explained our experimental work and one particular method and apparatus in accordance with the invention will be described with reference to the accompanying drawings in which.

DETAILED DESCRIPTION OF THE PREFERRED EMBODIMENT

Figure 1:
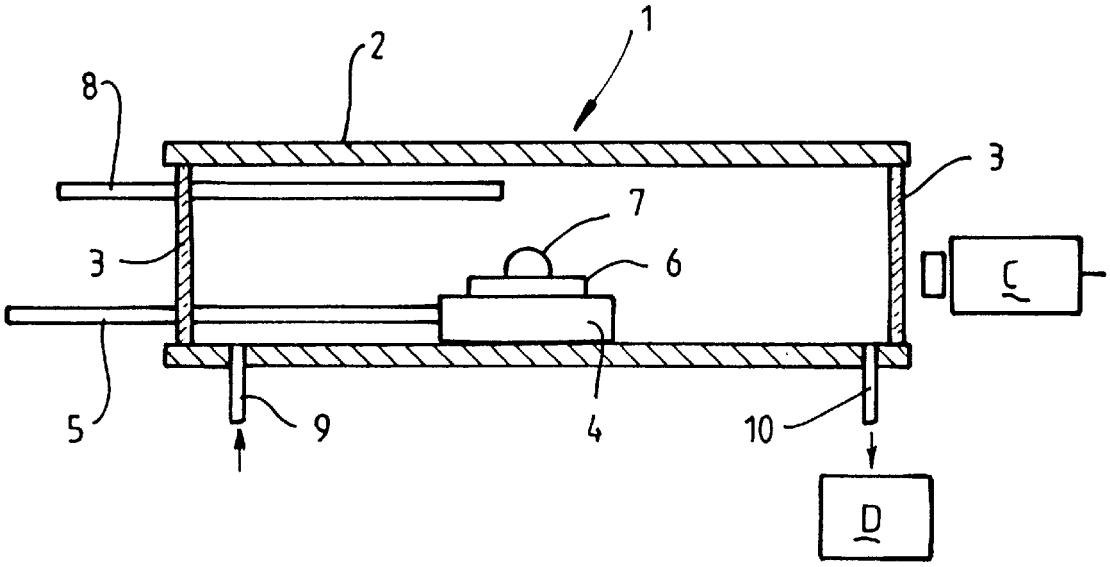
FIG. 1 diagrammatically illustrates an experimental apparatus for testing the reaction between a slag sample and a refractory substrate under conditions simulating those occurring in the casting pool of a strip caster.

FIG. 1 illustrates an experimental set-up for examining the reaction between a slag sample and a refractory substrate under conditions simulating those which apply in the casting pool of a twin roll caster. The apparatus comprising a test chamber 1 formed by arc alumina tube 2 closed at its ends by quartz windows 3.

Chamber 1 contains a graphite tray 4 which can be positioned by means of a graphite rod 5 extending out of the chamber. A sample refractory substrate 6 is placed on the tray 5 and supports a drop of a slag sample 7. The apparatus is located in an electric furnace to enable the refractory substrate and slag sample to be heated to temperatures of the order of 1600° C. to simulate the conditions occurring in the casting pool of a twin roll caster. The temperature is measured by a thermocouple 8 and the chamber is provided with a gas inlet 9 and gas outlet 10 to provide a flow of an inert gas and to enable the quantity of carbon monoxide generated by reaction between the slag sample 7 and the refractory substrate 6 to be measured by a detector D at the gas outlet. The physical condition of the slag sample 7 can be viewed by a CCD camera C which views the sample through one of the quartz windows 3.

FIGS. 2 to 11 show the results of tests in which samples of a typical slag generated by a silicon manganese killed steel were placed on three substrates of graphite of differing purities and ten substrates of differing refractory materials as summarised in Table 1.

TABLE 1

| | SAMPLES FOR COMPONENT TESTING | | | | | | | | | | | | |
|---|---|---|---|---|---|---|---|---|---|---|---|---|---|
| COMPONENT | 1 | 2 | 3 | 4 | 5 | 6 | 7 | 8 | 9 | 10 | 11 | 12 | 13 |
| 94% purity graphite | 100 | | | | | | | | | | | | |
| 98% purity graphite | | 100 | | | | | | | | | | | |
| 99% purity graphite | | | 100 | 30 | 30 | 30 | 30 | 30 | 20 | 10 | 30 | 30 | 30 |
| alumina | | | | Y | Y | Y | Y | Y | Y | Y | Y | Y | |
| spinel | | | | | | | | | | | | | Y |
| sodium addition | | | | | | 0.3 | 0.8 | | | | | | |
| silicon | | | | | | | | Y | Y | Y | | | |
| aluminium | | | | | | | | | | | Y | | |
| boron carbide | | | | | | | | | | | | Y | |
| resin binder | | | | | Y | Y | Y | Y | Y | Y | Y | Y | Y |

The slag used in the experiments comprised MnO and $Sio_2$ in the ratio 60:40.

Figure 2:
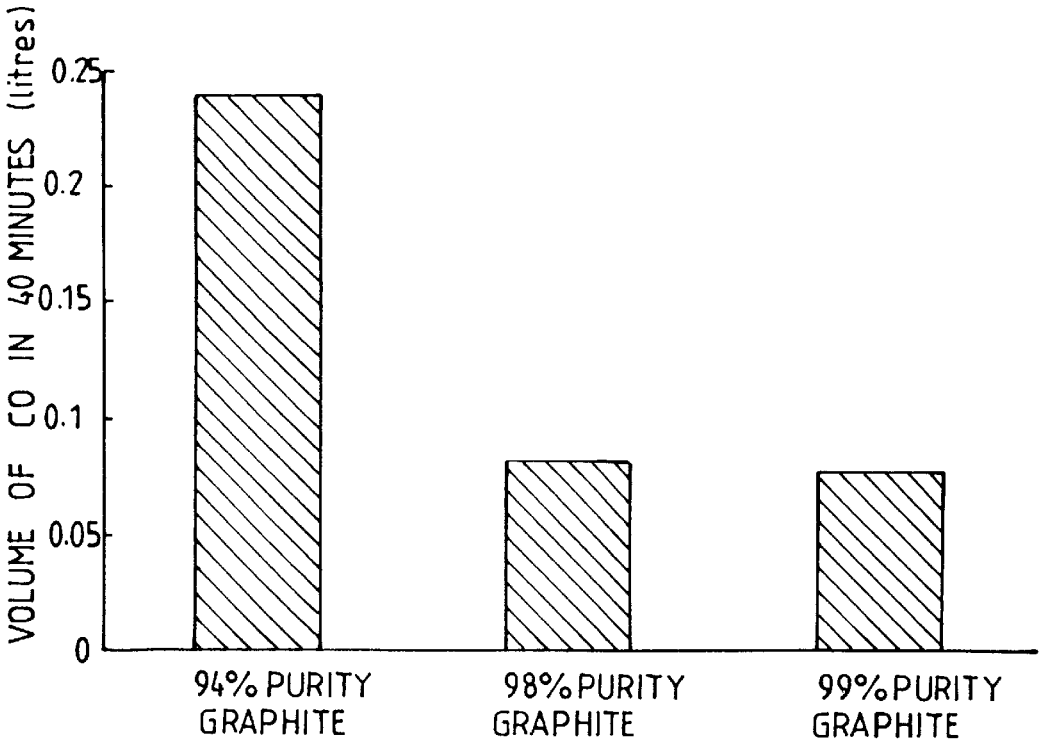
FIGS. 2 and 3 display the results of measurements of the volume of carbon monoxide generated during two particular tests using refractories with graphite of differing purities.
Figure 3:
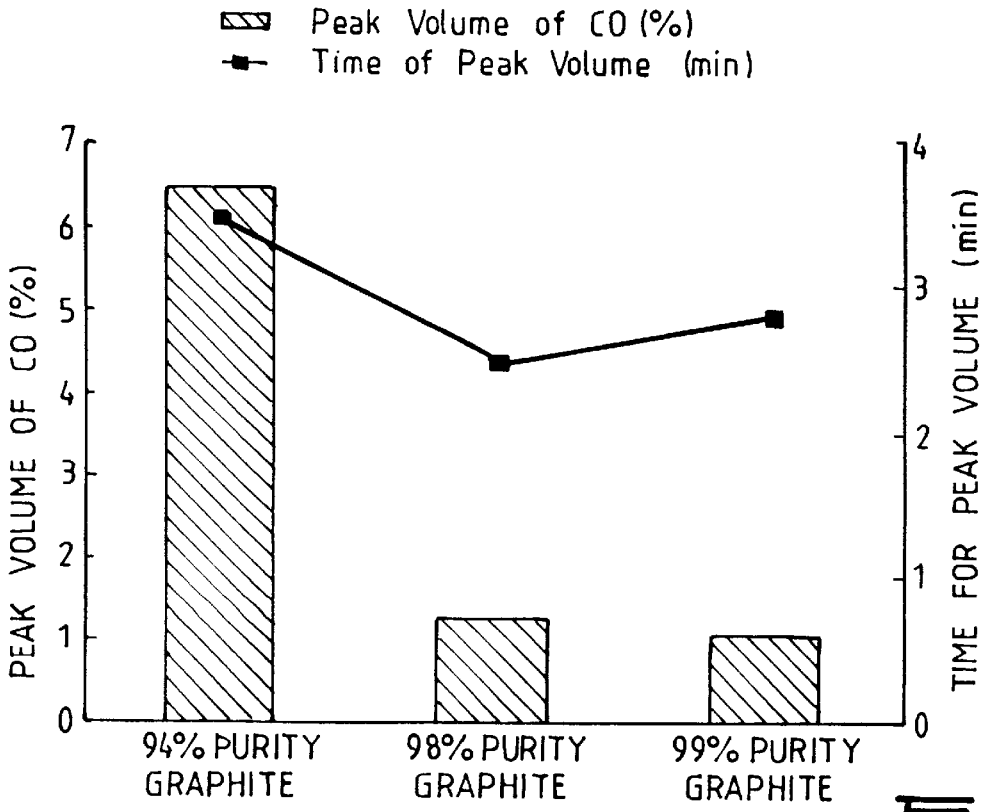

FIGS. 2 and 3 illustrate the results of tests carried out using graphite substrates of 94% purity, 98% purity and 99% purity set out as samples 1 to 3 in the above table.

Specifically, FIG. 2 plots total volume of carbon monoxide produced in 40 minute tests whereas FIG. 3 plots both the peak volume of carbon monoxide and the time of the peak volume. These tests were conducted to determine the effect of graphite purity on the reaction between graphite and a typical slag generated by a silicon manganese killed steel. It will be seen that there is a dramatic reduction in the generation of carbon monoxide if the purity of the graphite is increased from 94% to 98% purity, whereas the further increase in purity to 99% has little effect on the generation of carbon monoxide. During these tests it was observed that the droplet of slag material did not slump on the high purity substrates to the same degree as the slag on the 94% purity graphite. It is accordingly believed that the increased gas generation with the low purity graphite is due to the presence of gangue or ash impurities which are relatively porous and cause enhanced wetting of the substrate compared with the high purity graphite substrates which produced very high wetting angles through the period of the tests.

Figure 4:
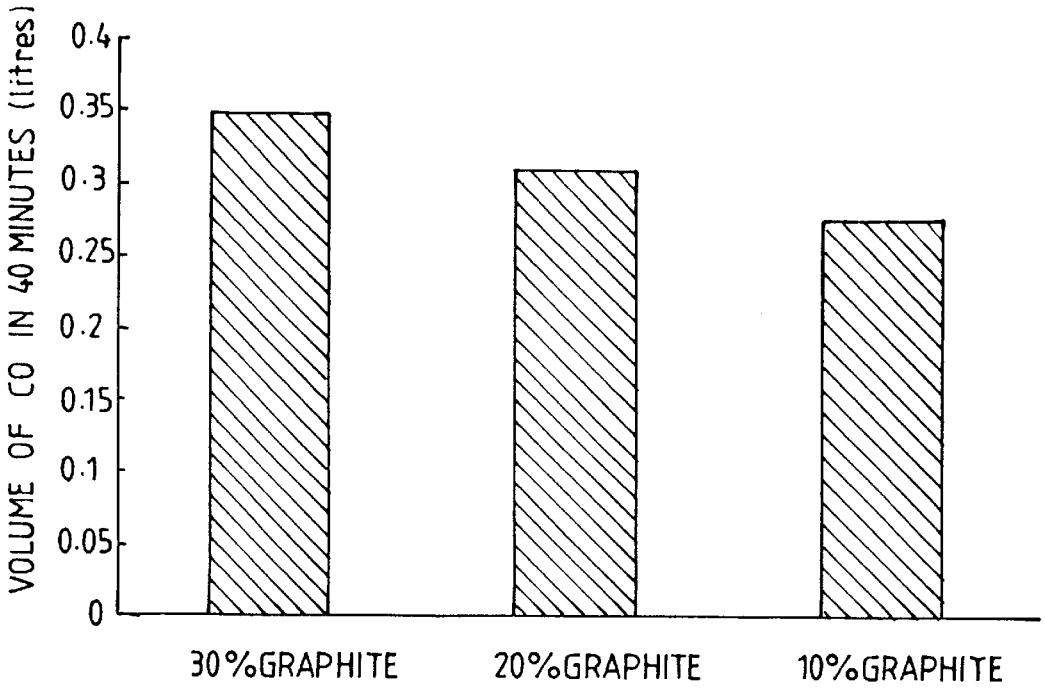
FIGS. 4 and 5 show experimental results demonstrating the effect of graphite content.
Figure 5:
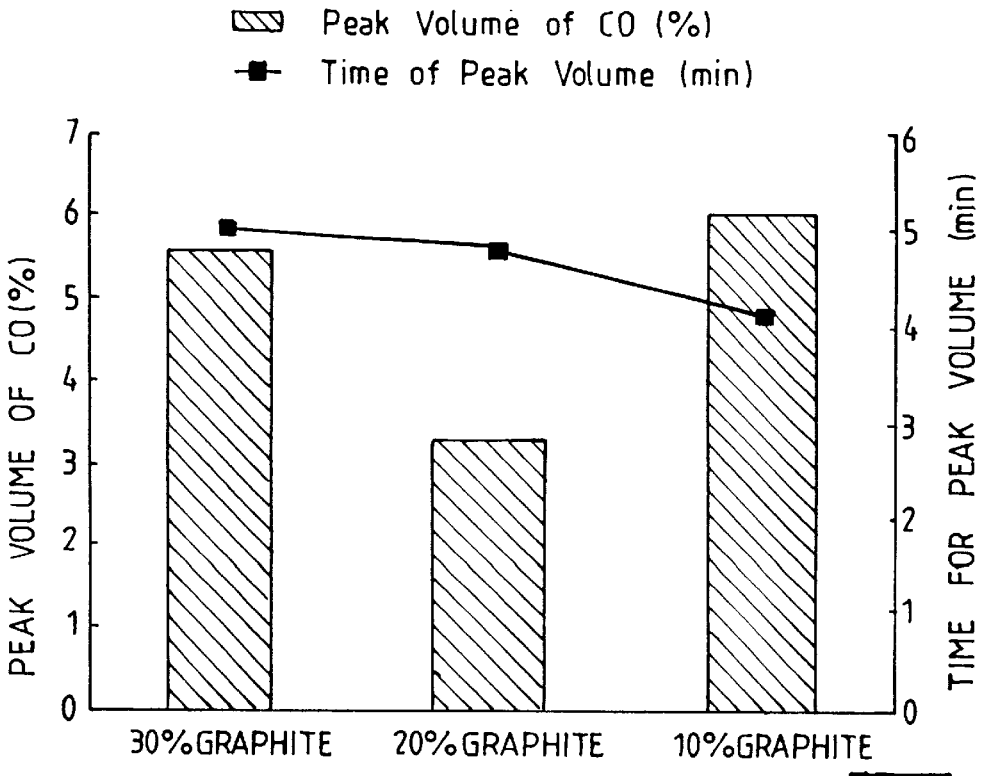

FIG. 4 illustrates the results of measurements of the total volume of carbon monoxide produced in 40 minute tests on the specific refractory substrate samples 8, 9 and 10 and FIG. 5 plots the peak volume of carbon monoxide measured during these tests. The refractory samples 8, 9 and 10 each comprised graphite of 99% purity but in the proportions 30%, 20% and 10% respectively. These tests were carried out to determine the effect of the amount of graphite in the refractory material. The tests show that the effect of varying the quantity of graphite in the refractory material is not as dramatic as the effect of the graphite purity but there are indications that the peak volume of carbon monoxide gas production is minimised if the proportion of graphite is around 20%. It is thought that this may be due to a balance between wetting and quantity effects. There is also a balance between thermal shock resistance, wetting effects and corrosion resistance. Thermal shock resistance and corrosion resistance are both reduced with decreasing carbon content. On the other hand, decreasing carbon content will lead to increased wetting of the substrate. Balancing these effects suggests an optimum graphite content in the range 20% to 24%.

Figure 6:
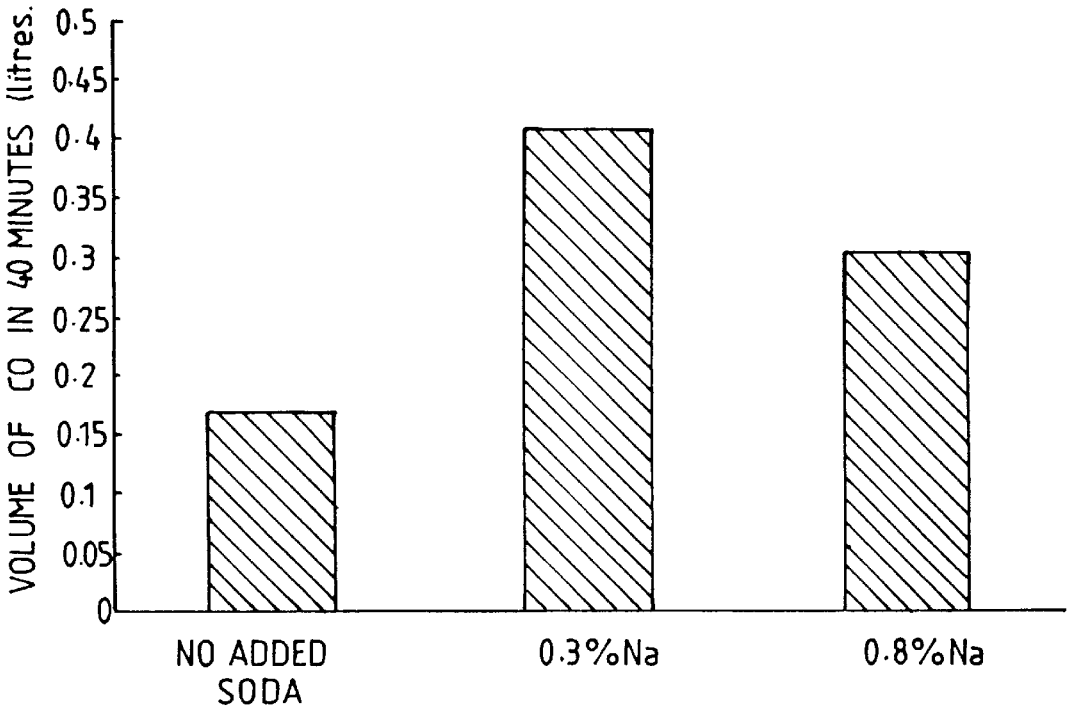
FIGS. 6 and 7 show experimental results demonstrating the effect of sodium addition.
Figure 7:
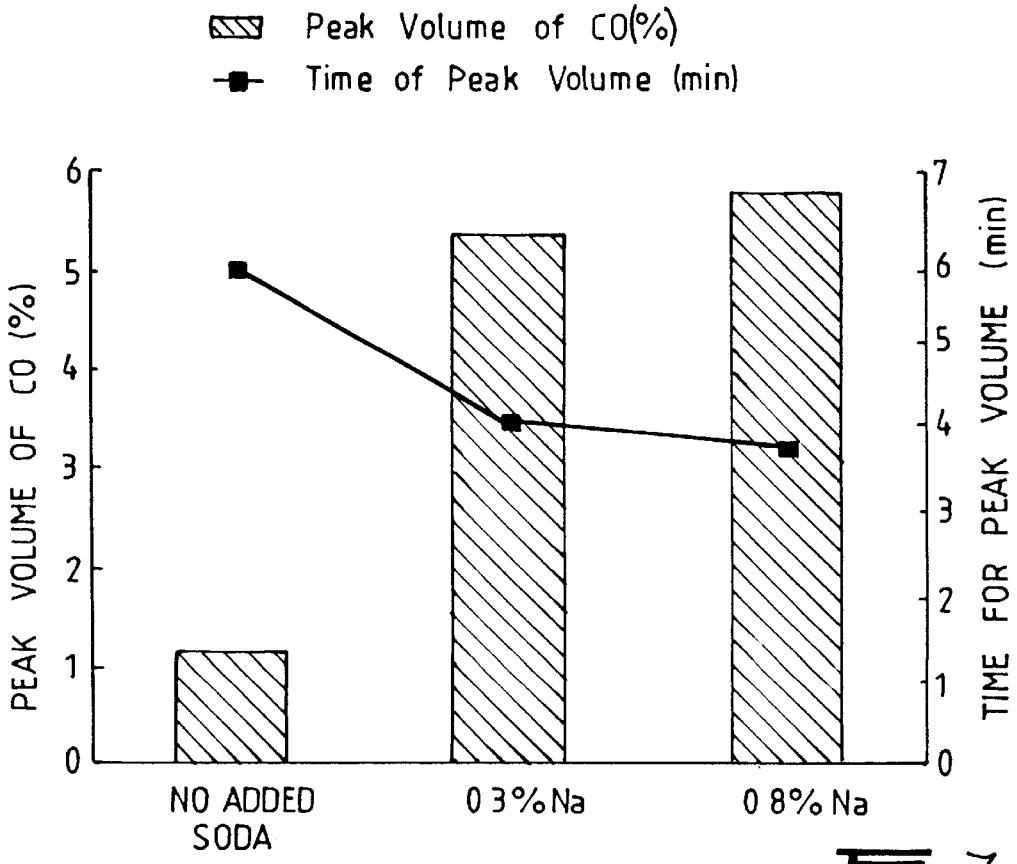

FIGS. 6 and 7 show the results of tests on substrate samples 5, 6 and 7 and were conducted to indicate the effect of the sodium content of anti-oxidant additives. FIG. 6 plots the total volume of carbon monoxide produced during the 40 minute test periods whereas FIG. 7 plots both the peak volume of carbon monoxide and the time of the peak volume in minutes. The results indicate that sodium addition has a very detrimental effect in increasing carbon monoxide gas generation. It is thought that this effect may be due to the action of sodium compounds as good wetting agents. The sodium additions were in the form of sodium silicate. It can be concluded that the refractory material should not contain sodium based anti-oxidant additives.

Figure 8:
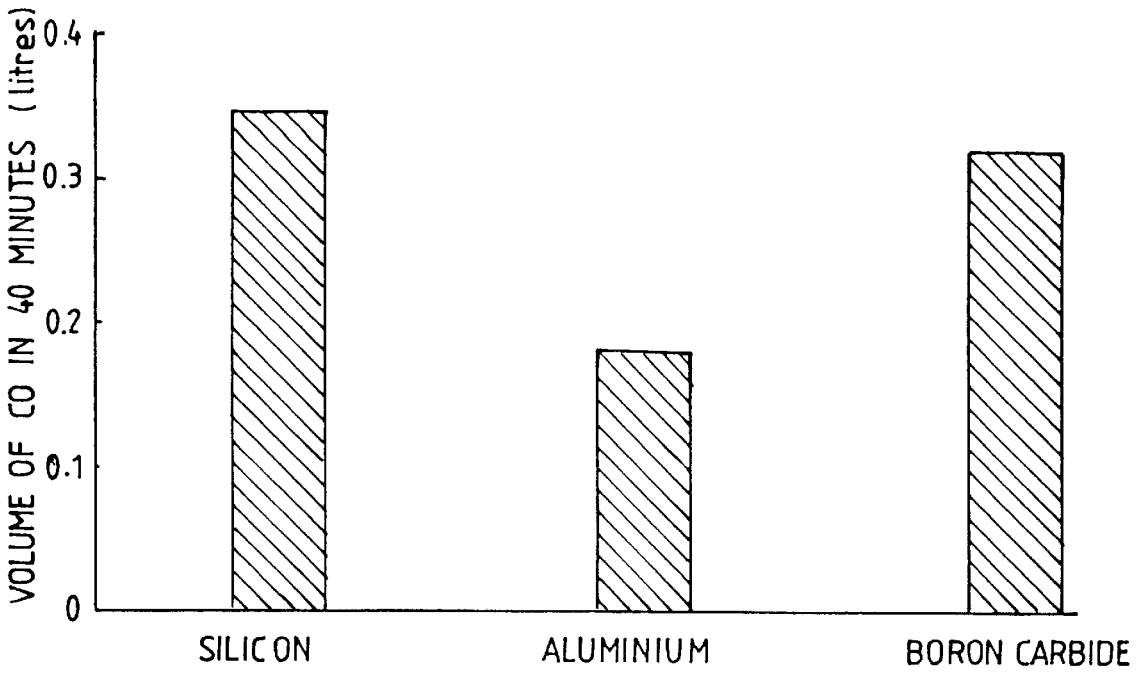
FIGS. 8 and 9 show experimental results demonstrating the effect of anti-oxidant type.
Figure 9:
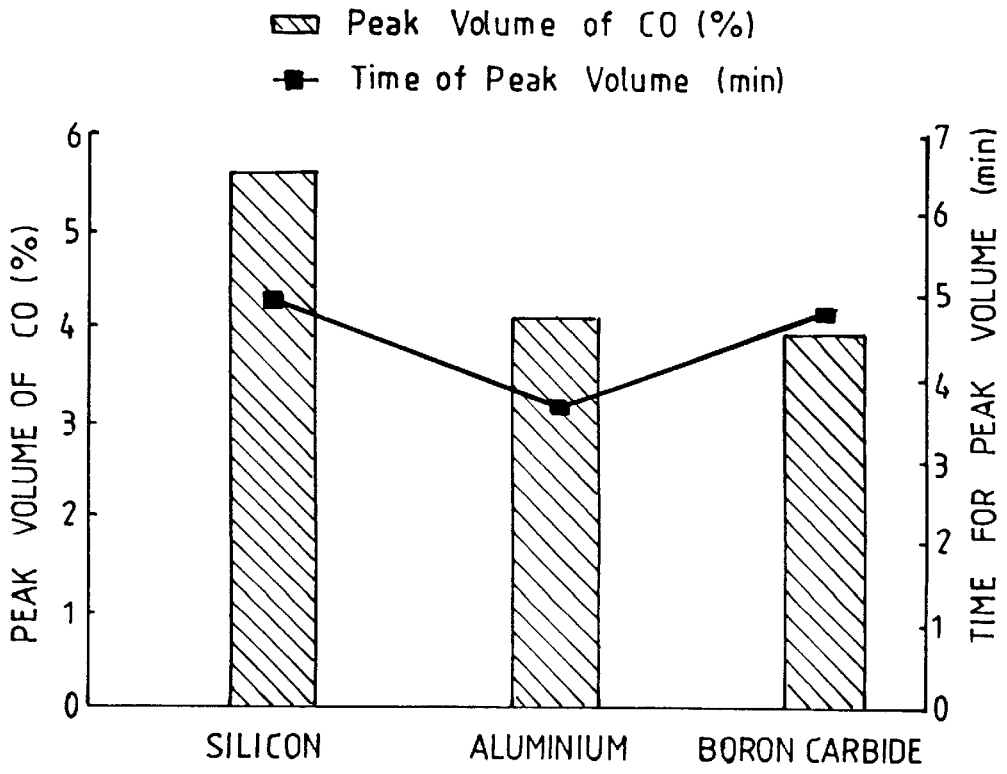

FIGS. 8 and 9 give the results of tests on samples 8, 11 and 12. These samples all had the same graphite level but used different anti-oxidant additives. The tests show that aluminium based anti-oxidant additives will result in less carbon monoxide generation than additives containing silicon or boron carbide. Observation of the slag sample during these tests showed that the slag droplet slumped on the substrates containing silicon and boron carbide whereas the slag droplet on the substrate containing the aluminium additive actually contracted to demonstrate a less wetting condition as the substrate was heated and it stayed in this condition throughout the test. This indicates that the aluminium additive suppresses wetting of the slag on the refractory material to help minimise generation of carbon monoxide gas.

Figure 10:
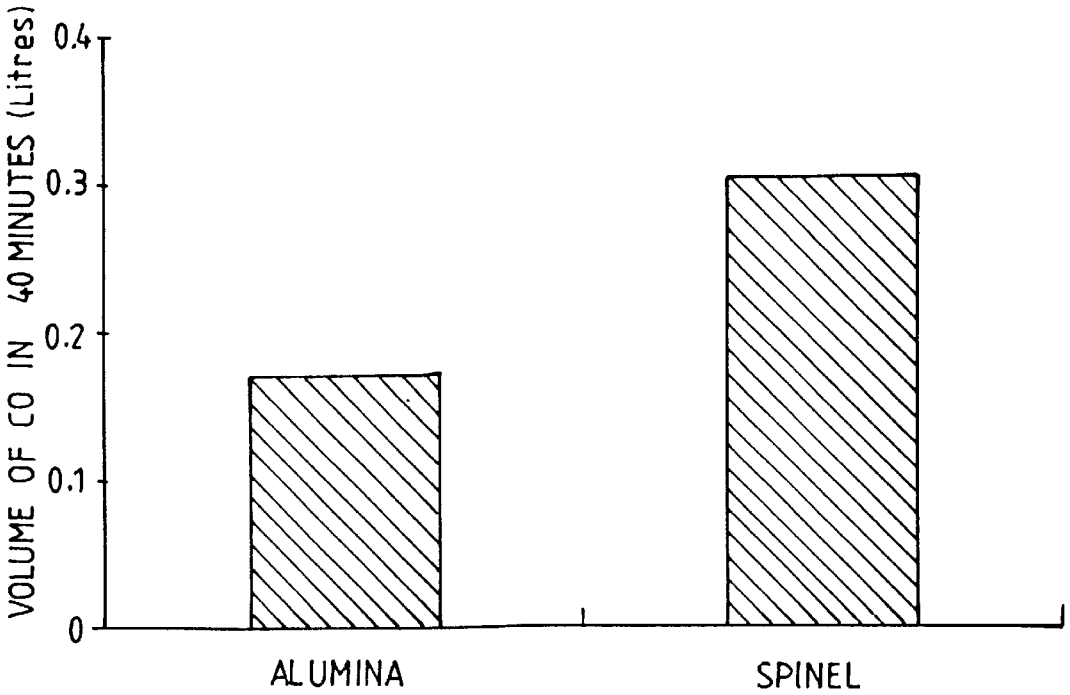
FIGS. 10 and 11 show experimental results demonstrating the effect of aggregate type.
Figure 11:
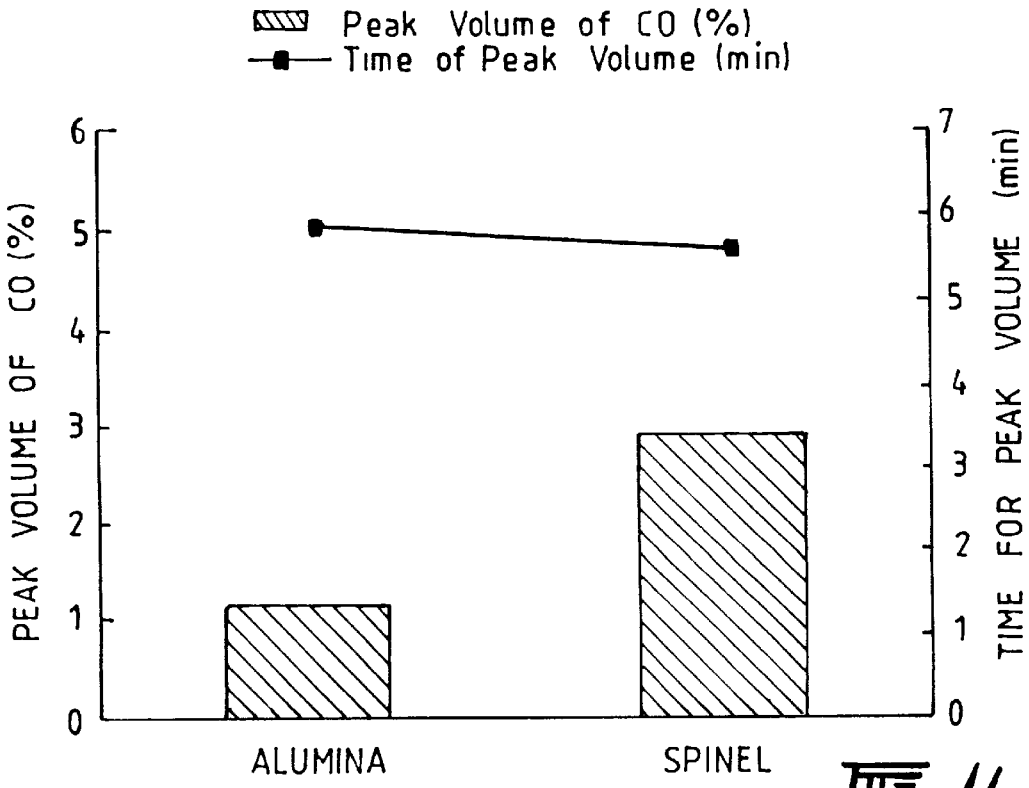
Figure 12:
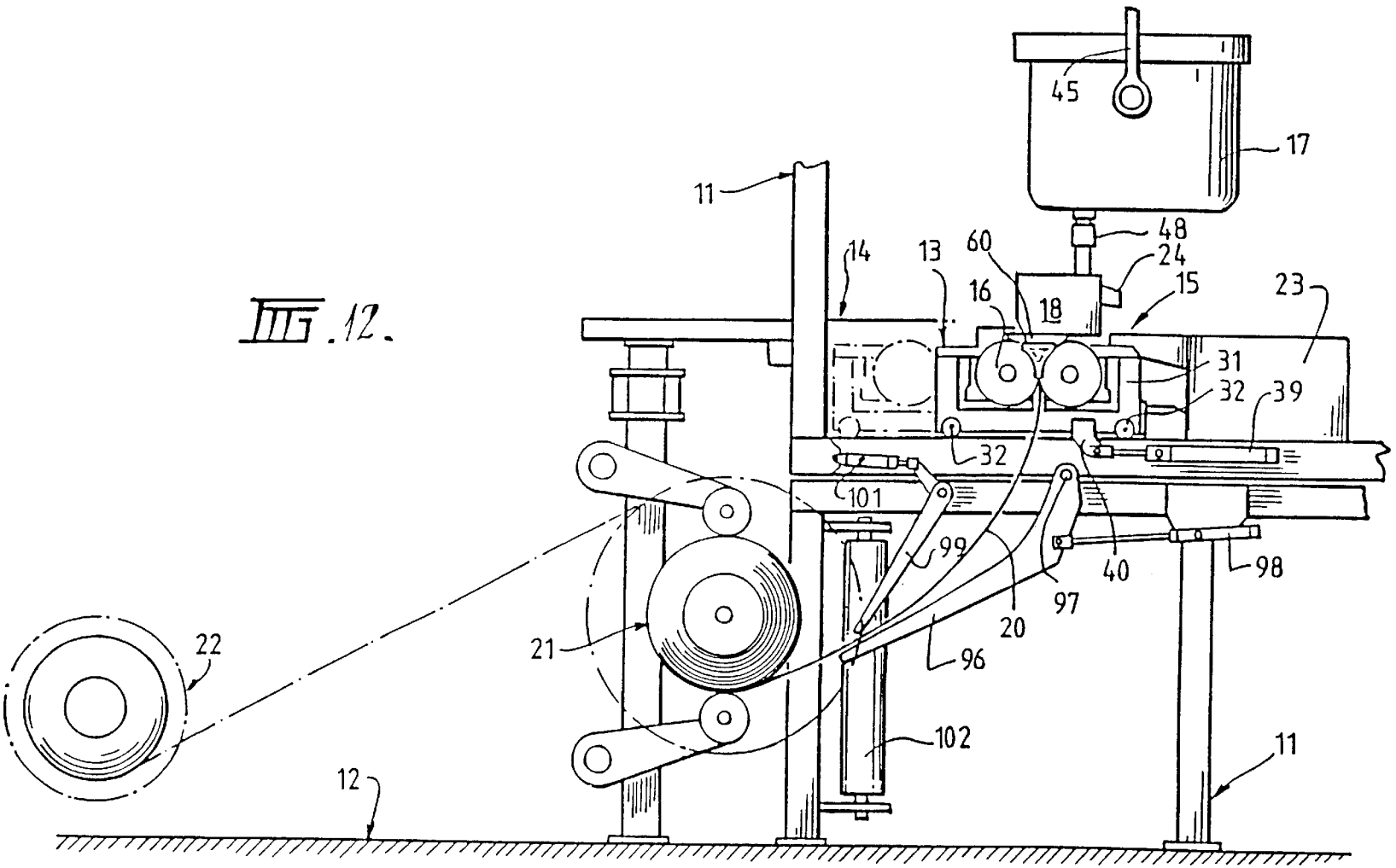
FIG. 12 illustrates a twin roll continuous strip caster constructed and operating in accordance with the present invention.
Figure 13:
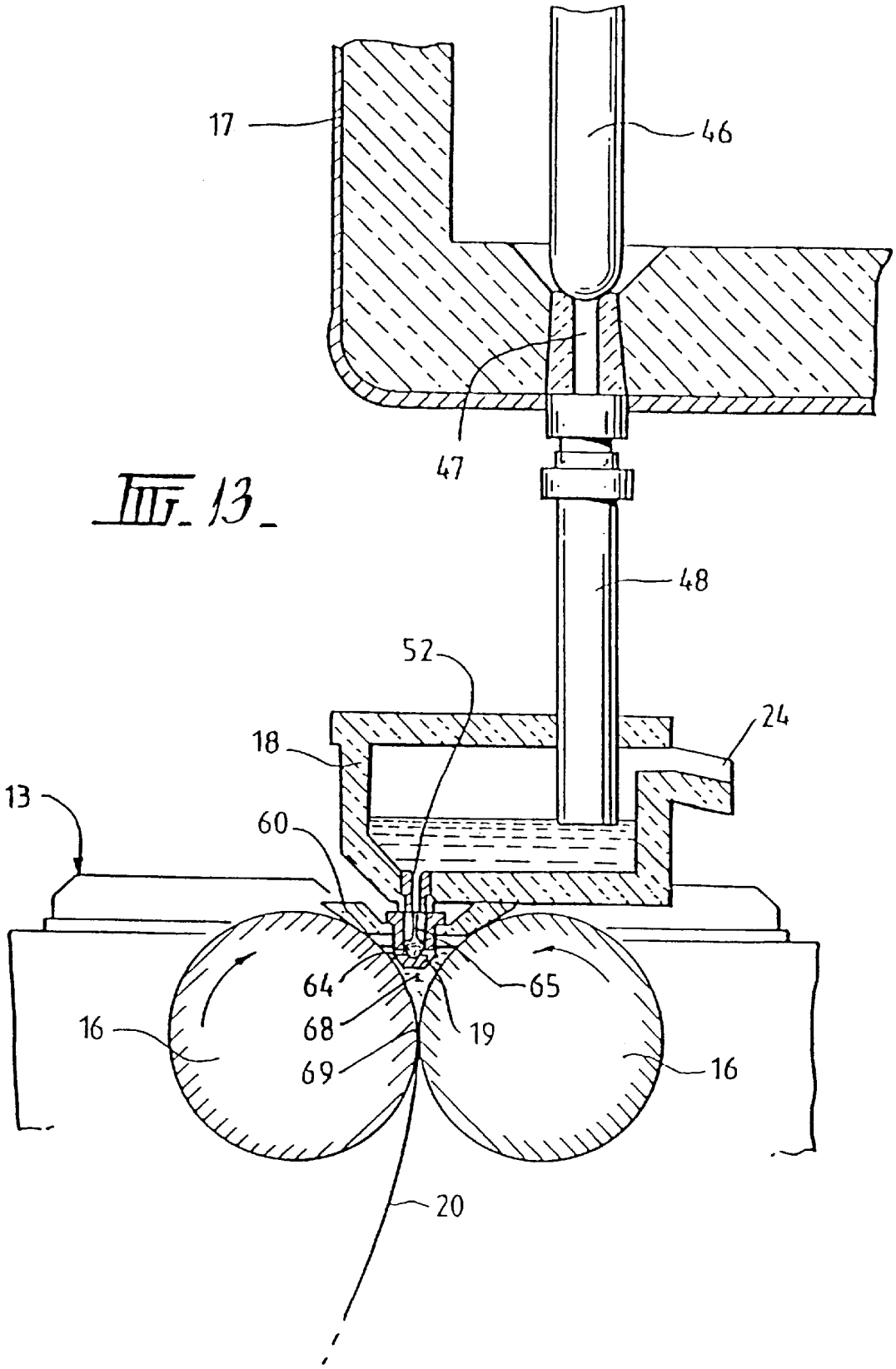
FIG. 13 is a vertical cross-section through important components of the caster illustrated in FIG. 12 including a metal delivery nozzle constructed in accordance with the invention.
Figure 14:
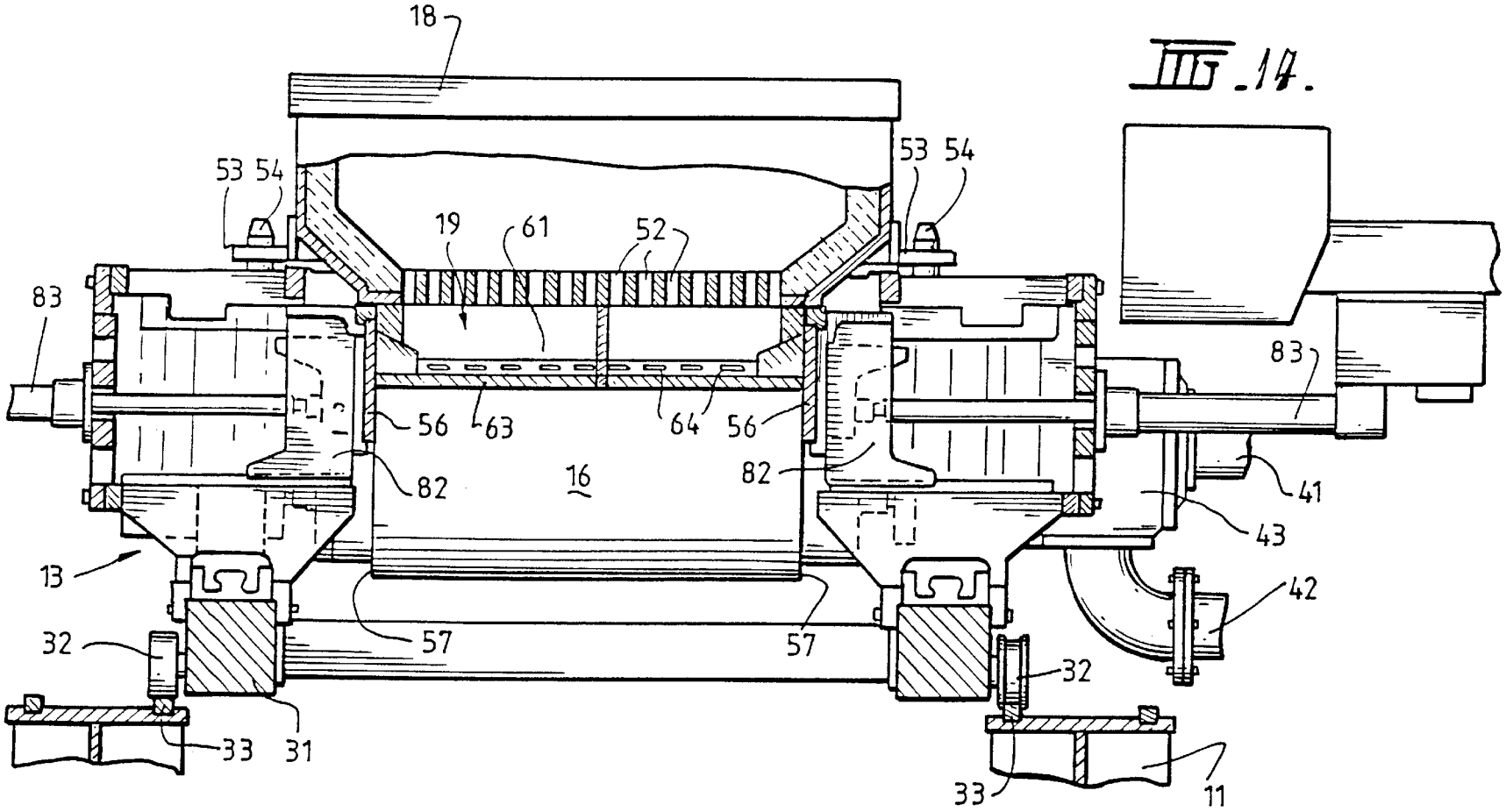
FIG. 14 is a further vertical cross-section through important components of the caster taken transverse to the section of FIG. 13.

FIGS. 10 and 11 give the results of tests using the refractory substrate samples 12 and 13 to compare the effect of using spinel as an aggregate instead of alumina. These tests indicate that the use of alumina as the basic refractory aggregate material results in low carbon monoxide gas generation and that aggregates containing aluminium may be preferred to other aggregates.

The results of the testing program indicate that the amount of carbon monoxide generation can be reduced by using a refractory material which includes high purity graphite (preferably of the order of 98% purity), a low proportion of graphite (preferably in the range 20% to 24%) and by selecting additives and aggregates that reduce carbon monoxide generation from reaction with the slag, particularly additives and aggregates containing aluminium.

Table 2 gives the results of further testing of selected refractory compositions under like conditions to the other samples tested with the volume of carbon monoxide generated after 40 minutes by reaction with a typical slag sample being recorded.

TABLE 2

FURTHER REFRACTORY MATERIALS TESTED

| COMPONENTS* | A | B | C | D |
|---|---|---|---|---|
| Graphite Purity (%) | 94 | 94 | 98 | 98 |
| Graphite Content (%) | 22 | 15 | 15 | 15 |
| Additives | silicon and "soda" flux | silicon and boron carbide | aluminium-silicon alloy | silicon and boron carbide |
| Volume of CO after 40 min. (L) | 0.60 | 0.39 | 0.13 | 0.53 |

*Other than refractory aggregates being mainly alumina.

It can be seen from Table 2 that sample C, which is a combination of all the chosen materials and which is according to the invention, displays an unusually good result of 0.13 litres of carbon monoxide. Sample D establishes that the replacement of anti-oxidant additive being a metal alloy according to the invention, with another known anti-oxidant such as silicon and boron carbide, is detrimental to gas generation.

Based on the results of some of the tests referred to earlier, two metal delivery nozzles having the composition C were used to cast a heat of silicon/manganese killed low carbon steel of over 40 tonnes and no meniscus marks were observed throughout the cast. However, the metal delivery nozzles were noted to be cracked after casting. Subsequent investigation suggested this to be due to thermal shock and thus it is considered that 15% graphite is the minimum amount of graphite needed according to the invention.

FIGS. 12 to 16 illustrates a twin roll continuous strip caster constructed and operated in accordance with the present invention. This caster comprises a main machine frame 11 which stands up from the factory floor 12. Frame 11 supports a casting roll carriage 13 which is horizontally moveable between an assembly station 14 and a casting station 15. Carriage 13 carries a pair of parallel casting rolls 16 to which molten metal is supplied during a casting operation from a ladle 17 via a distributor 18 and delivery nozzle 19. Casting rolls 16 are water cooled so that shells solidify on the moving roll surfaces and are brought together at the nip between them to produce a solidified strip product 20 at the nip outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor.

Roll carriage 13 comprises a carriage frame 31 mounted by wheels 32 on rails 33 extending along part of the main machine frame 11 whereby roll carriage 13 as a whole is mounted for movement along the rails 33. Carriage 13 is moveable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra-rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 2 m long in order to produce up to 2 m wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is formed as a wide dish made of a refractory material such as high alumina castable with a sacrificial lining. One side of the distributor receives molten metal from the ladle and is provided with the aforesaid overflow 24. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as accurately to locate the distributor.

Figure 15:
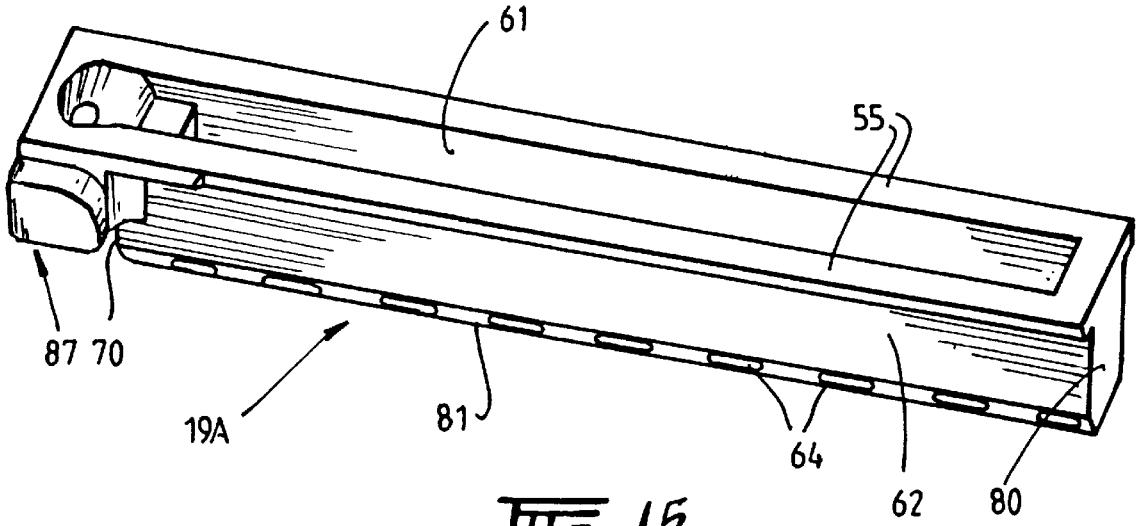
FIG. 15 is a perspective view of the delivery nozzle segment.
Figure 16:
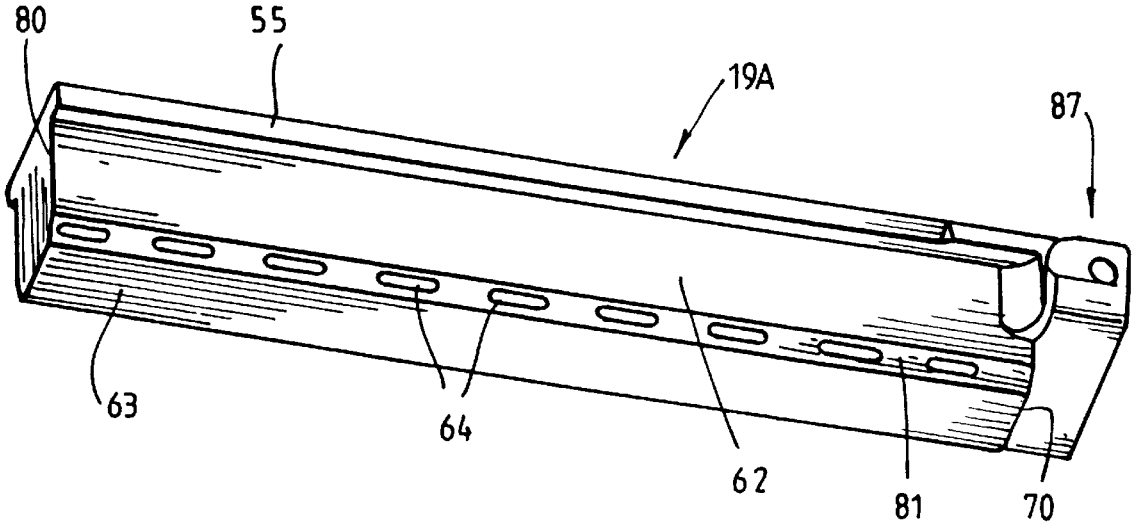
FIG. 16 is an inverted perspective view of the nozzle segment.

Delivery nozzle 19 is formed in two identical half segments which are made of alumina graphite refractory material and are held end to end to form the complete nozzle. FIGS. 15 and 16 illustrate the construction of the nozzle segments 19A which are supported on the roll carriage frame by a mounting bracket 60, the upper parts of the nozzle segments being formed with outwardly projecting side flanges 55 which locate on that mounting bracket.

Each nozzle half segment is of generally trough formation so that the nozzle 19 defines an upwardly opening inlet trough 61 to receive molten metal flowing downwardly from the openings 52 of the distributor. Trough 61 is formed between nozzle side walls 62 and end walls 70 and may be considered to be transversely partitioned between its ends by the two flat end walls 80 of the nozzle segments which are brought together in the completed nozzle. The bottom of the trough is closed by a horizontal bottom floor 63 which meets the trough side walls 62 at chamfered bottom corners 81. The nozzle is provided at these bottom corners with a series of side openings in the form of longitudinally spaced elongate slots 64 arranged at regular longitudinal spacing along the nozzle. Slots 64 are positioned to provide for egress of molten metal from the trough generally at the level of the trough floor 63.

The outer ends of the nozzle segments are provided with end formations denoted generally as 87 extending outwardly beyond the nozzle end wall 70 and provided with metal flow passages to direct separate flows of molten metal to the "triple point" regions of the pool ie those regions of the pool where the two rolls and the side dam plates come together. The purpose of directing hot metal to those regions is to prevent the formation of "skulls" due to premature solidification of metal in these regions.

Molten metal falls from the outlet openings 52 of the distributor in a series of free-falling vertical streams 65 into the bottom part of the nozzle trough 61. Molten metal flows from this reservoir out through the side openings 64 to form a casting pool 68 supported above the nip 69 between the casting rolls 16. The casting pool is confined at the ends of rolls 16 by a pair of side closure plates 56 which are held against the ends 57 of the rolls. Side closure plates 56 are made of strong refractory material, for example boron nitride. They are mounted in plate holders 82 which are moveable by actuation of a pair of hydraulic cylinder unites 83 to bring the side plates into engagement with the ends of the casting rolls to form end closures for the casting pool of molten metal.

During a casting operation the ladle stopper rod 46 is actuated to allow molten metal to pour from the ladle to the distributor through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

In the casting operation the flow of metal is controlled to maintain the casting pool at a level such that the lower end of the delivery nozzle 19 is submerged in the casting pool and the two series of horizontally spaced side openings 64 of the delivery nozzle are disposed immediately beneath the surface of the casting pool. The molten metal flows through the openings 64 in two laterally outwardly directed jet streams in the general vicinity of the casting pool surface so as to impinge on the cooling surfaces of the rolls in the immediate vicinity of the pool surface. This maximises the temperature of the molten metal delivered to the meniscus regions of the pool and it has been found that this significantly reduces the formation of cracks and meniscus marks on the melting strip surface.

The illustrated apparatus can be operated to establish a casting pool which rises to a level above the bottom of the delivery nozzle so that the casting pool surface is above the floor of the nozzle trough and at about the same level as the metal within the trough. Under these conditions it is possible to obtain stable pool conditions and if the outlet slots are angled downwardly to a sufficient degree it is possible to obtain a quiescent pool surface.

Metal delivery nozzle 19 is made primarily of alumina graphite. Typically it may comprise of the order of 75% to 78% $Al_2O_3$, and 20% to 24% of 98% purity graphite. It also contains a metal alloy containing aluminium as an anti-oxidant and binder. Previously, metal delivery nozzles for strip casting have a typical chemical composition of the order of 58% $Al_2O_3$, 5% $ZrO_2$ and 32% C with the graphite component of the carbon content having a purity of around 94%. It has been found that the high oxygen content of silicon/manganese killed steels, along with reducible oxides in the slag causes leaching of carbon from such refractory materials to produce carbon monoxide bubbles in the casting pool which leads to meniscus marks in the manner previously described. The use of the modified refractory material containing high purity graphite and the inclusion of aluminium or aluminium alloy anti-oxidant additive in accordance with the present invention has enabled the generation of carbon monoxide bubbles in the casting pool to be substantially eliminated.

The refractory delivery nozzle segments may be formed by cold isostatic pressing the selected refractory formulation in powder form and then firing the pressed body at a temperature of the order of 1000° C. in a reducing atmosphere, for example in an oven containing coke or in a sealed canister.

I claim:

1. A method of continuously casting steel strip comprising:

introducing molten steel between a pair of chilled casting rolls via a metal delivery nozzle disposed above the nip between the rolls to form a casting pool of molten steel supported above the nip, and rotating the rolls so as to cast the solidified strip delivered downwardly from the nip;

wherein the delivery nozzle dips into the casting pool and is comprised of a refractory material comprising a major proportion of a refractory aggregate and a minor proportion of graphite in the range of 15 to 25% by weight and an anti-oxidant additive being aluminium or an alloy thereof and wherein the graphite has a purity of at least 96%.

2. A method as claimed in claim 1, wherein the purity of the graphite is of the order of 98% or higher.

3. A method as claimed in claim 1, wherein the proportion of graphite is in the range of about 20% to about 24% by weight.

4. A method as claimed in claim 2, wherein the proportion of graphite is in the range of about 20% to about 24% by weight.

5. A method as claimed in claim 1, wherein the amount of the anti-oxidant additive is about 2% by weight.

6. A method as claimed in claim 1, wherein the refractory aggregate comprises any one or more of the compounds alumina, magnesia, zirconia and spinel.

7. A method as claimed in claim 1, wherein the refractory aggregate is comprised mainly of alumina.

8. A method as claimed in claim 1, wherein the refractory material of the nozzle is essentially free of sodium.

9. Apparatus for casting steel strip, comprising a pair of parallel casting rolls forming a nip between them, an elongate delivery nozzle disposed above and extending along the nip between the casting rolls for delivery of molten steel into the nip to form a casting pool of molten steel supported on casting surfaces of the rolls above the nip, and means to rotate the rolls to produce a solidified strip passing downwardly from the nip, wherein the delivery nozzle is positioned to dip into the casting pool and is formed of a refractory material comprising a major proportion of a refractory aggregate and a minor proportion of graphite in the range of 15 to 25% by weight and an anti-oxidant additive being aluminium or an alloy thereof and wherein the graphite has a purity of at least 96%.

10. Apparatus as claimed in claim 9, wherein the purity of the graphite is of the order of 99% or higher.

11. Apparatus as claimed in claim 9, the proportion of graphite is in the range of about 20% to about 24% by weight.

12. Apparatus as claimed in claim 10, the proportion of graphite is in the range of about 20% to about 24% by weight.

13. Apparatus as claimed in claim 9, wherein the amount of the anti-oxidant additive is about 2% by weight.

14. Apparatus as claimed in claim 9, wherein the anti-oxidant is aluminium-silicon alloy.

15. Apparatus as claimed in claim 9, the refractory aggregate comprises any one or more of the compounds alumina, magnesia, zirconia and spinel.

16. Apparatus as claimed in claim 9, wherein the refractory aggregate is comprised mainly of alumina.

17. A metal delivery nozzle for delivering molten steel to a nip between a pair of casting rolls of a twin roll caster, comprising a refractory body defining an upwardly opening inlet adapted to receive molten metal and bottom outlet means for outflow of the molten metal wherein the refractory body is made of a refractory material comprising a major proportion of a refractory aggregate and a minor proportion graphite in the range of 15 to 25% by weight and an anti-oxidant additive being aluminium or an alloy thereof and wherein the graphite has a purity of at least 96%.

18. A metal delivery nozzle as claimed in claim 17, wherein the purity of the graphite is of the order of 98% or higher.

19. A metal delivery nozzle as claimed in claim 18, wherein the proportion of graphite is in the range of about 20% to about 24% by weight.

20. A metal delivery nozzle as claimed in claim 19, wherein the amount of the anti-oxidant additive is about 2% by weight.

21. A metal delivery nozzle as claimed in claim 19, wherein the anti-oxidant is aluminium-silicon alloy.

22. A metal delivery nozzle as claimed in claim 17, wherein the refractory aggregate comprises any one or more of the compounds alumina, magnesia, zirconia and spinel.

23. A metal delivery nozzle as claimed in claim 17, wherein the refractory aggregate is comprised mainly of alumina.

24. A metal delivery nozzle as claimed in claim 17, wherein the refractory body is of elongate form and the inlet is shaped as a trough extending along the body.

25. A metal delivery nozzle as claimed in claim 24, wherein the outlet means comprises outlet openings for outflow of metal from the bottom of the trough laterally outwards from both sides of the nozzle.

26. A metal delivery nozzle as claimed in claim 25, wherein the purity of the graphite is of the order of 98% or higher, the proportion of graphite is in the range of about 20% to about 24% by weight, and wherein the amount of the anti-oxidant additive is about 2% by weight.

* * * * *